US008205278B2

(12) United States Patent
Thomas et al.

(10) Patent No.: US 8,205,278 B2
(45) Date of Patent: Jun. 26, 2012

(54) WASHING APPARATUS

(76) Inventors: Ronald G. Thomas, Wales (GB); Anthony P. Beanlands, Wales (GB)

( * ) Notice: Subject to any disclaimer, the term of this patent is extended or adjusted under 35 U.S.C. 154(b) by 1084 days.

(21) Appl. No.: 12/062,167

(22) Filed: Apr. 3, 2008

(65) Prior Publication Data

US 2008/0245393 A1 Oct. 9, 2008

(51) Int. Cl.
*A47K 3/06* (2006.01)

(52) U.S. Cl. ..... 4/585; 4/615

(58) Field of Classification Search ..... 4/601, 585, 4/587

See application file for complete search history.

(56) References Cited

U.S. PATENT DOCUMENTS

| | | | | |
|---|---|---|---|---|
| 3,677,263 | A * | 7/1972 | Allen | 601/17 |
| 4,055,863 | A | 11/1977 | Duval | |
| 4,935,971 | A | 6/1990 | Dunn et al. | |
| 6,266,830 | B1 | 7/2001 | Danno et al. | |
| 7,731,739 | B2 * | 6/2010 | Schock et al. | 607/107 |
| 2006/0070178 | A1 | 4/2006 | Taheri | |

FOREIGN PATENT DOCUMENTS

| | | |
|---|---|---|
| JP | 2000233012 | 8/2000 |
| JP | 2000342646 | 12/2000 |

* cited by examiner

*Primary Examiner* — Gregory Huson
*Assistant Examiner* — Karen L Younkins
(74) *Attorney, Agent, or Firm* — Gifford, Krass, Sprinkle, Anderson & Citkowski, P.C.; Mark D. Schneider

(57) ABSTRACT

Apparatus for washing a body comprising a. a body membrane adapted to receive a body therein, the body membrane having a plurality of body portions, each body portion having:
   i. an exterior surface and an interior surface;
   ii. a water conduit for passage of water through the body membrane to the interior surface thereof;
   iii. an air conduit separate to the water conduit for passage of air through the body membrane to the interior surface thereof; and b. control means operable to control the passage of water and air independently through the water and air conduits respectively, the control means further operable to control the passage of water and air in each body portion independently.

Also provided is a method of washing a body using said apparatus.

9 Claims, 4 Drawing Sheets

WASHING APPARATUS

BACKGROUND TO THE INVENTION

The present invention relates to an apparatus to facilitate the washing of a body. In particular, the present invention relates to an apparatus for facilitating the washing of a human body in either the standing, sitting or prone position.

It is a common problem that individuals who are incapacitated, such as the elderly or infirm, may have limited mobility and therefore experience difficulty using a shower or bath in order to wash their bodies. Even when provided with support in the form of a nurse or carer, such individuals may find that negotiating the sides of a bath or coping with the standing or sitting under a shower requires more flexibility than they are able to demonstrate or may be too tiring for them to cope with. Furthermore, some invalids may be unable to leave their bed in order to wash.

One existing solution for such individuals, which are hereafter referred to as patients, is the conventional bed-bath, which is traditionally administered by a carer or nurse. However, such a solution requires strength and effort on the part of the carer, often does not result in particularly thorough washing and drying of the patient, and does not afford the patient much privacy or respect.

Alternative solutions include various devices for encasing all or a portion of the patient's body and channeling water at the body in order to perform the washing function. However, such devices often require that the patient is turned over part way through the process which requires effort on the part of the carer or the patient and may be inconvenient and/or uncomfortable for some patients. Other devices require operation by a third party, thereby failing to overcome the issue of patient privacy during the washing process. And most devices fail to either clean or dry the patient properly, which can lead to bed-sores, skin inflammation and/or infections and the like.

There is therefore a need in the prior art for a device to allow efficient, hygienic and effective washing of the body and which allows the privacy of the patient to be respected throughout the process, whilst minimising discomfort for the patient.

SUMMARY OF THE INVENTION

The present invention seeks to address the problems of the prior art.

Accordingly, a first aspect of the present invention provides an apparatus for washing a body comprising a. a body membrane adapted to receive a body therein, the body membrane having a plurality of body portions, each body portion having:
   i. an exterior surface and an interior surface;
   ii. a water conduit for passage of water through the body membrane to the interior surface thereof;
   iii. an air conduit separate to the water conduit for passage of air through the body membrane to the interior surface thereof; and b. control means operable to control the passage of water and air independently through the water and air conduits respectively, the control means further operable to control the passage of water and air in each body portion independently.

The control means is operable to control the passage of water and air independently through the water and air conduits respectively. Thus, water may be supplied to the interior of the body membrane when air is not and vice versa. In addition, if desired, water and air may be supplied to the interior of the body membrane at the same time.

The control means is further operable to control the passage of water and air in each body portion independently. This means that the supply of air and water can be controlled separately for each body portion.

In this way, the body may be washed in stages rather than the whole body being subjected to water and/or air flow. In this way, the washing process may be carried out in a way that is less traumatic and more gentle on the patient without shocking the whole of the patient's body at the same time by exposure to an alternative environment which may perhaps be at a different temperature to the body of the patient and will certainly expose the skin of the patient's body to different sensations.

The water and air conduits are preferably provided with a plurality of conduit outlets at the interior surface of the body membrane through which water and air, respectively, may exit the conduits and made contact with a body received within the body membrane.

Thus, the washing process may begin with air and water being supplied to a first body portion at a first end of the body membrane. This is preferably at the end of the body membrane accommodating the head and/or shoulders of the body received therein. If the body is being washed in a prone position, it is advantageous if the body is angled slightly, for example, with the head end raised in order to facilitate the running off of waste water within the body membrane during the washing process.

The supply of air will have the effect of slightly inflating the body membrane, thereby lifting the interior surface of the body membrane away from the skin of the body. Thus, the water conduit outlets at the interior surface of the body membrane are slightly lifted away from the skin of the body and the flow of water from the water conduit outlets may leave the conduit and make contact with the body in a spray-like manner thereby effectively targeting the water at the body surface.

The supply of air will also have the effect of channeling waste water from the washing process down the body in a direction away from the head region of the body where the waste water may exit the body membrane though a suitable outlet means. Such outlet means may comprise a drainage member, a waste fluid conduit or any other suitable water outlet means known to the skilled person and suitable for allowing removal of the waste water from the body membrane during the washing process.

Once the portion of the body at the first end portion of the body membrane has been washed, warm air may be supplied through the air conduit to the interior of the first end portion of the body membrane whilst the water flow to the first end portion of the body membrane is stopped. This allows the portion of the body received within the first end portion of the body membrane to be dried after washing. In the meantime, water is then supplied to the adjacent body portion of the body membrane in order to wash the portion of the body received within the adjacent portion of the body membrane. The warm air flow through the first end body portion assists in drying the skin of the portion of the body received therein and also flows over the surface of the body into the adjacent membrane body portion where it assists in encouraging the flow of water in the adjacent membrane body portion down the body in a direction away from the first end portion of the body membrane, where it may be drained away from the body membrane.

This process continues until the water and subsequent air flow has occurred in each body portion of the body membrane, until finally, in the body portion furthest from the first end body portion, warm air is supplied to dry the skin of the portion of the body received therein, before the process is complete and the apparatus may be switched of, either manually or automatically.

In one embodiment, the air conduit has a larger cross-sectional area than the water conduit. This is helpful in ensuring that no more water is used that is actually required for the washing process. Typically, a lesser volume of water is required during the washing process that the volume of warm air required to dry the skin of a body received within the body membrane after the washing process is complete. Thus, an air conduit may have a cross-sectional diameter of greater than around 0.75 inches, and preferably at around or greater than 1 inch. A water conduit may have a cross-sectional diameter of from around 0.5 to 0.9 inches, and preferably around 0.375 inches.

The water and air supplied through the water and air conduits respectively may be supplied under pressure to assist in the flow of the water and air through the conduits and subsequently through the body membrane. For example, the water may be supplied at between around 20 and 60 psi, and preferably between around 30 and 50 psi. More preferably, the water may be supplied to the interior of the body membrane at around 40 psi.

The body membrane may comprise any suitable water-resistant or water-proof material known to the skilled person, including, but not limited to, plastics-based materials such as polyvinylchloride and the like.

The body membrane is preferably a disposable article, thus preventing the spread of infections from re-use of a body-encapsulating membrane which is not properly cleaned between uses. In addition, the effort and time of having to clean the body membrane is avoided by using disposable body membranes. However, it will be appreciated that the body membrane could be cleaned and re-used if desired.

The body membrane 20 may be transparent or may be opaque, coloured or patterned as desired and in dependence upon the privacy requirements of the user.

Where the body membrane is disposable, the air and water conduits extending from the exterior to the interior of the membrane may be provided integrally with the body membrane, for example, by manufacturing the body membrane using a single pressing technique where the pressing creates the air and water conduits within the body membrane wall. The controller may be simply attached to the body membrane, along with water supply and air supply so that the water and air flow into the water and air conduits in each body portion of the body membrane may be controlled. The controller preferably comprises a valve mechanism and may be manually or electronically operated.

In one embodiment, the body membrane is adapted to receive the whole of a body therein. Alternatively, it will be appreciated that the body membrane may be designed to receive only a portion of a body therein, for example, to receive the whole of the body except for an injured portion which should not be allowed to become wet.

The controller may be provided adjacent the body membrane. This allows the patient whose body is received within the device to operate the apparatus on their own if they wish, thereby removing the need for a carer or nurse to be present when they are undergoing washing. Thus, the patient is afforded a higher degree of privacy than would be the case for example if a bed bath was applied or if the patient was merely helped into a bath or shower and manually washed therein by a carer or nurse. If the patient is capable of undressing and wrapping the body membrane properly around them then they have the option of also operating the water and air flow through the apparatus on their own if the controller is located adjacent the body membrane. If the patient is washing the whole of their body within the body membrane, the controller may be supplied or moved to the interior of the body membrane, thereby allowing the patient to operate the apparatus from within the body membrane.

In a further embodiment, the apparatus may further comprise support pads located on the interior surface of the body membrane on which a body may be supported when received within the body membrane. The support pads may comprise any suitable resilient water-resistant or water-proof material and are intended to allow a body received within the body membrane to be raised up slightly from the wall of the body membrane on which the body is lying. This creates a gap between the interior wall of the body membrane and the skin of the body received therein, thereby allowing the water flow better access to the skin of the body. In addition, such support pads add to the comfort of the experience of the patient.

A further aspect of the present invention provides a method of washing a body comprising the steps of:

a. providing an apparatus in accordance with a first aspect of the present invention;
b. locating the body within the apparatus;
c. operating the controller to provide water at a body portion located at a first end of the apparatus;
d. subsequently operating the controller to air only at the first end portion and water at a body portion adjacent the body portion located at the first end of the apparatus;
e. continuing steps c. and d. until water is provided at a final body portion at the end of the apparatus opposing the first end portion; and
f. stopping the water supply and providing air only at the final body portion.

BRIEF DESCRIPTION OF THE DRAWINGS

An embodiment of the invention will now be described, by way of example only, and with reference to the accompanying drawings, in which.

DETAILED DESCRIPTION OF THE INVENTION

Figure 1:
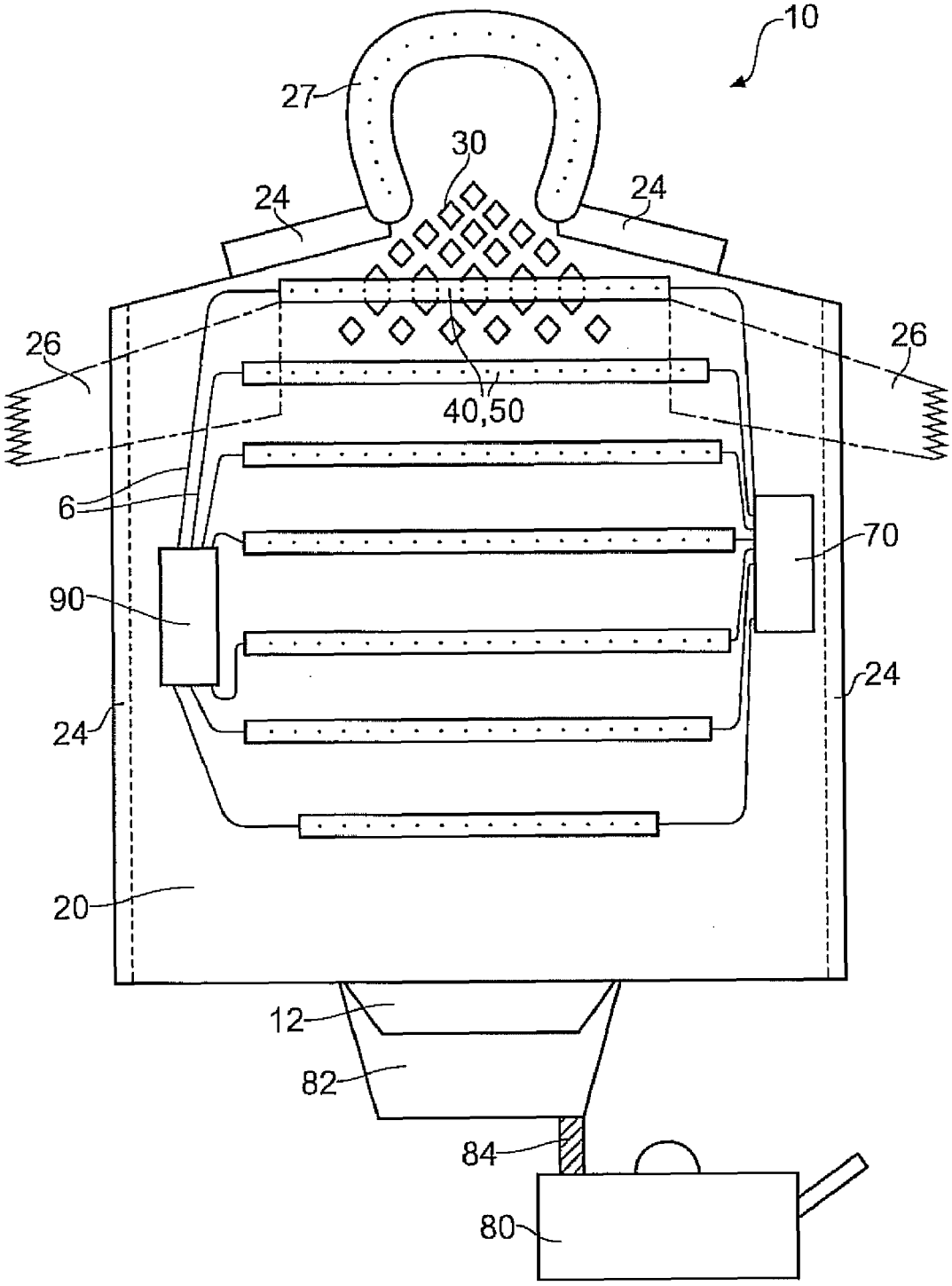
FIG. 1 is a plan view from above of an embodiment of a device in accordance with a first aspect of the present invention, with the device in an open configuration.
Figures 2, 3:
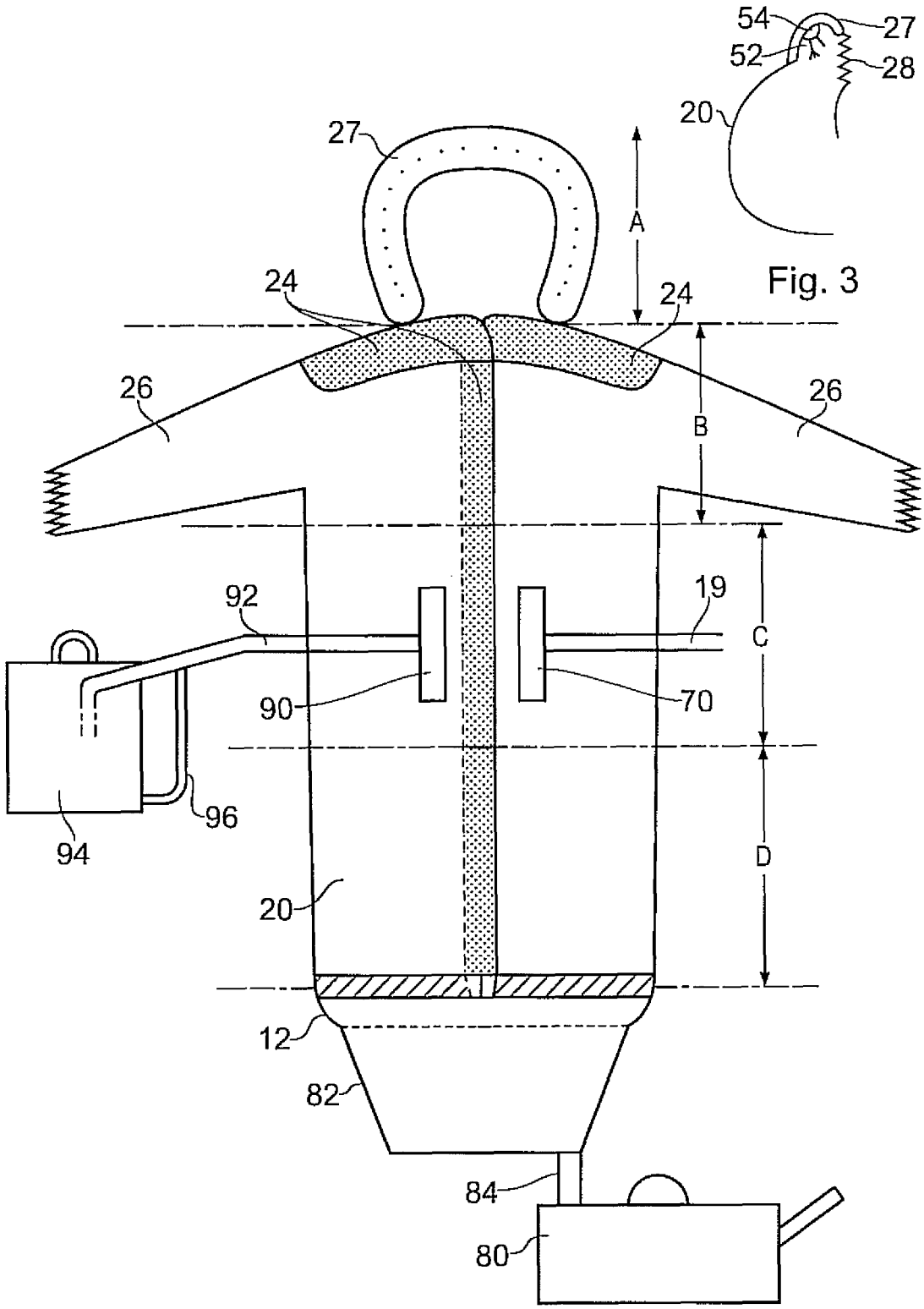
FIG. 2 is a plan view of the embodiment of FIG. 1, with the device shown in a closed configuration.
FIG. 3 is a side view of a part of the head portion of the embodiment of FIG. 1, illustrating the arrangement for location around the face of a user.

FIGS. 1 and 2 show an apparatus 10 comprising a body membrane 20. In FIG. 1, the body membrane is shown in an open configuration on which a patient to be washed would be positioned prior to beginning the washing procedure. FIG. 2 shows the body membrane 20 in a closed configuration within which a body of a patient would be received during the washing procedure.

Body membrane 20 comprises a substantially planer sheet with arm formations 26 and a sealing portion 24 which is adapted to seal around the head of a patient in the hairline region during use.

The patient simply lies on top of the body membrane 20 of FIG. 1 and, if desired, inserts their arms through arm formations 26. Body membrane 20 is then simply closed by drawing sealing portions 24 together in a sealed manner and closing sealing flap 12. It will be appreciated that where a patient does not have sufficient mobility to take advantage of the arm formations 26, the arms can be omitted from the design of the body membrane 20, or alternatively, the arm formations 26 may be sealed so that the body membrane 20 may be used for the washing procedure without waste water building up in the empty space in arm formations 26. It will be appreciated that the extremities of arm formations 26 may be sealed so that waste water will not escape through the ends of arm formations 26 during the washing procedure. Alternatively, the arms formations 26 may seal around the wrists of the arms of the patient.

Body membrane 20 comprises a water-resistant or waterproof material, such as a plastics-based material, for example polyvinylchloride (PVC).

Body membrane 20 may be provided with support pads 30 on the interior surface thereof. Such support pads 30 are located such that the body of a user may rest on support pads 30, thus increasing the comfort for the user and raising the skin of the user slightly above the interior surface of body membrane 20 so that a gap exists between the skin of the body of the user and the interior surface of body membrane 20 during the washing procedure. Support pads 30 may comprise any suitable resilient water-resistant or water-proof material, such as a suitable plastics-based foam. However, it will be understood that any other suitable resistant material may be used as an alternative.

Body membrane 20 is provided with a plurality of air conduits 40 and water conduits 50, distributed around the whole of the body membrane 20, through which air and water, respectively, are introduced to the interior of body membrane 20 during the washing procedure. Water supply manifold 90 is provided in fluid communication with the water conduits 50 and air supply manifold 70 is provided in connection with air conduits 40 through which air is supplied to air conduits 40 in use.

Reservoir 80 is provided in connection with one end of body membrane 20 so as to collect waste water exiting the body membrane during the washing procedure, the waste water travelling through foot sump 82 and connecting pipe 84 before entering reservoir 80. Reservoir 80 may be drained in the normal manner through any suitable domestic drain or a sink arrangement, or may be collected and disposed of at an alternative location.

It will be appreciated that, although the water conduits 50 are referred to as carrying water, other fluids may be transported through the water conduits instead of or in addition to water, such as cleaning fluids and/or medical treatment fluids, such as infection-fighting chemicals and the like.

Water supply manifold 90 is connected via delivery water pipe 92 to an input water supply 94, which may be comprise any suitable water supply source, such as a water tank and pump arrangement. Such water tanks and pump arrangements are well-known and freely commercially available. Should any additives such as soaps, shampoos, medical lotions, moisturising lotions or the like be required for delivery along with the water, additives may be added using an additive pipeline 96 which joins with delivery pipeline 92 which delivers water to the water supply manifold 90 and then to water conduits 50 arranged adjacent body membrane 20 of apparatus 10.

FIG. 3 shows part of the head portion of apparatus 10, which comprises a resilient portion 27 connecting a sealing portion 28 to body membrane 20. In use, sealing portion 28 is arranged around the face of a user contained within the closed body membrane 20, the sealing portion 28 being arranged approximately around the hairline of the user, so as to prevent water escaping down the face of a user during the washing process. As the body membrane is flexible, the head portion of the patient may also be massaged for the purposes of supplementing the cleaning of the head, if desired.

Figure 4:
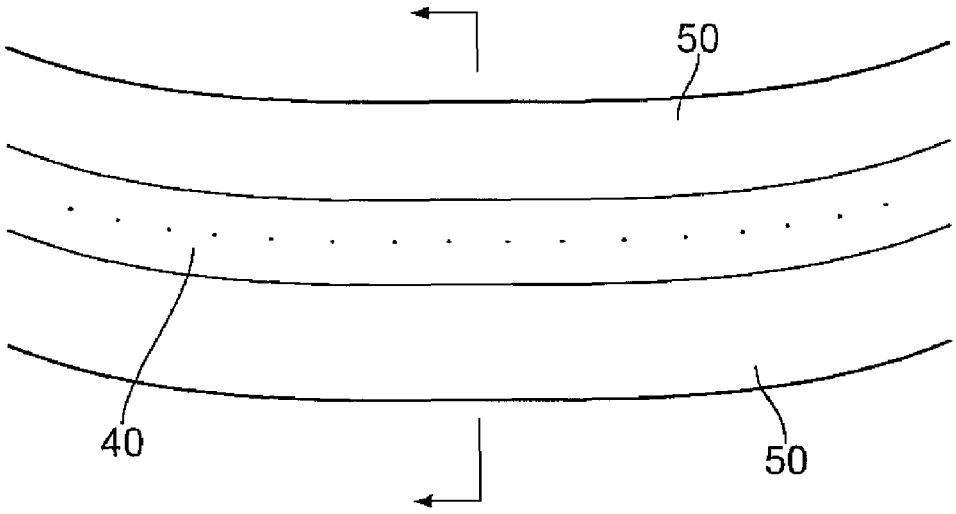
FIG. 4 is a cross-sectional view through the water and air ducts of the embodiment of FIG. 1.

FIG. 4 is a cross-sectional view through the water and air ducts of apparatus 10, showing air conduits 40 and water conduits 50 arranged adjacent each other in body membrane 20. The air and water conduits 40, 50, respectively, may be manufactured as part of the body membrane 20 using a single pressing manufacturing technique. This allows the production of body membrane 20 incorporating air and water conduits 40, 50 at little expense, thereby allowing body membrane 20 to be a disposable item.

Figure 5:
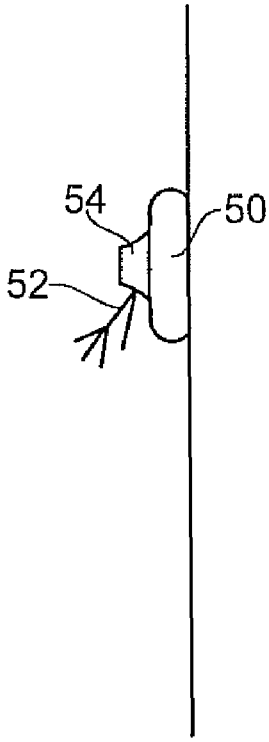
FIG. 5 is a side view of the water and aid duct outlets at the inner surface of the body membrane of the embodiment of FIG. 1.

FIG. 5 shows the air and water conduits 40, 50 from the side, with a representation of a water jet 52 being emitted from the nozzle outlet 54 of a water conduit 50. Each water conduit 50 is provide with multiple outlet nozzles 54 through water jets 50 may be emitted during the washing process. Similarly, air conduits 40 are provided with multiple air outlets (not shown) through which air may be passed at the interior surface of body membrane 20 during the washing and drying process.

Figure 6:
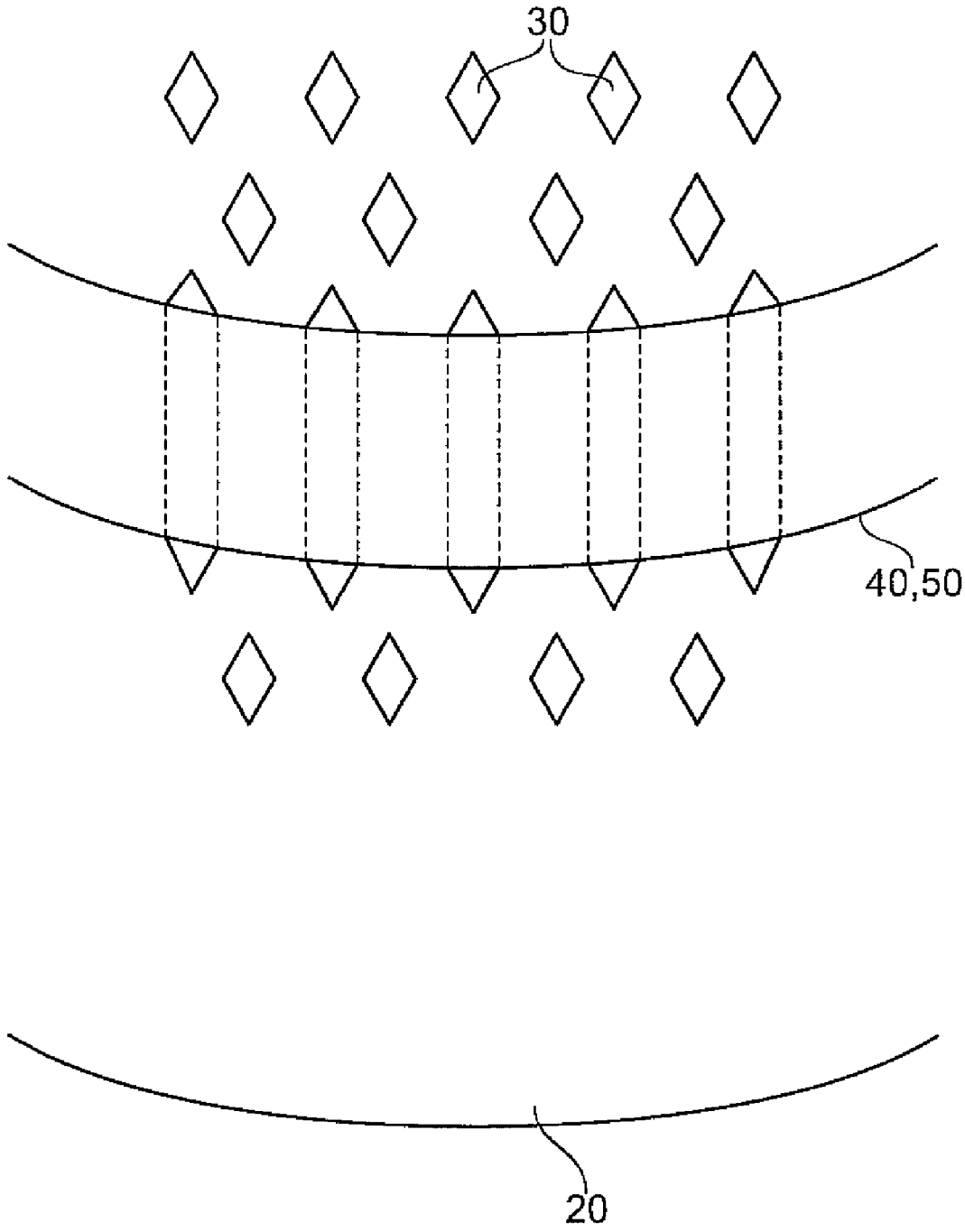
FIG. 6 is a plan view of the inner surface of the rear face of the body member of the embodiment of FIG. 1.

FIG. 6 shows the support pads 30 previously described and provided on the interior surface of body membrane on which the body of a user is supported during the washing process. Air and water conduits 40, 50 are also shown located adjacent body membrane 20.

Body membrane 20 is separated into several discreet portions A, B, C and D. Air conduits 40 and water conduits 50 are provided in each segment A, B, C, D, and are independently operable by means of controller (not shown) in order to deliver air and/or water to each segment independently from each other segment during the washing process.

Therefore in use, the body of a user is laid on top of the interior surface of body membrane 20 whilst body membrane 20 is in the open position, as shown in FIG. 1. The body membrane 20 is then gathered around the individual and closed in a sealed manner by the bringing together of sealing portions 24, thus encapsulating the body of a person within body membrane 20. Controller 60 is then operated in order to initiate the washing process which begins at the head portion of body membrane 20, that is segment A, where water (together with any other desired additives) is introduced into the interior of body membrane 20 through outlet nozzles 54 of water conduits 50. After sufficient water has been introduced to wash the body portion within segment A, for example after one minute, the water supply to water conduits 50 in segment A is stopped and warm air is supplied through air conduits 40 in segment A in order to begin drying the surface portion of the body retained within segment A. At the same time, water is then supplied to water conduits 50 in segment B, in order to wash the next portion of the body of the person received within body membrane 20. In other words, the portion of the body received within segment B now undergoes the washing procedure. The warm air supplied through air conduits 40 in segment A serves to not only dry the skin of the portion of the body received in segment A, but also serves to drive the water delivered at segment B in a downwards direction towards the remaining sections which have not yet experienced the washing procedure. Once sufficient water has been delivered to wash the portion of the body received within segment B, the water supplied to segment B is halted and air is supplied to segment B through air conduits 40. At this point, water is introduced to water conduits 50 in segment C in order to wash the portion of the body received within segment C of body membrane 20. Once sufficient water has been delivered to clean that portion of the body received within segment C, water supplied to segment C is halted and water is then delivered to water conduits 50 in segment D. Warm air is then delivered to air conduits 40 in segment C so as to dry that portion of the body received within segment C of body membrane 20.

Air supplied to each segment is stopped when sufficient air has been delivered to dry the portion of the body received within that particular segment. Once the air supply has been stopped in the final segment, segment D in the embodiment shown in the accompanying drawings, the washing procedure is complete and controller 60 will operate to halt both water and air supply to body membrane 20.

When the washing procedure is complete, the body membrane 20 may be re-opened by separating opposing sealing portions 24, thereby allowing the body of the patient to be removed from body membrane 20. Body membrane 20 may then be simply disconnected from the air and water supply, and any power supply used to operate controller 60, and body membrane 20 disposed of in a suitable manner.

Although the embodiment described has segments A to D, it is to be understood that the body membrane may have as many segments as desired for the particular washing procedure to be undertaken and the time in which is to be completed.

Where the decision is made to retain the body membrane for reuse, the body membrane may be cleaned and disinfected by simply feeding water (plus cleaning/disinfectant additives) and air through the apparatus to clean and/or disinfect as previously described.

The next time the washing procedure is repeated, a fresh body membrane 20 may be used simply by connecting body membrane 20 to the air and water supplies and any necessary power supply to operate controller 60.

It will be appreciated that controller 60 may comprise a simple valve arrangement which may be operated manually and therefore not require a power input. Alternatively, controller 60 may be an automated device which requires a power supply in order to control the washing procedure through apparatus 10.

At a pressure of 40 psi using 10 pin holes, it took around 8 minutes for 2 litres of water to be delivered though the apparatus. For each segment, around 40 pinholes were used to delivery around 1 litre of water per minute.

Although aspects of the invention have been described with reference to the embodiment shown in the accompanying drawings, it is to be understood that the invention is not limited to the precise embodiment shown and that various changes and modifications may be effected without further inventive skill and effort. For example, it will be appreciated that whilst the present invention is described for use with invalid or infirm individuals, the invention may find equal application for able bodied individuals where water is scarce or where space and therefore bathing availability is at a premium, for example when caravanning or camping.

The invention claimed is:

1. Apparatus for washing a body comprising a. a body membrane including multiple interconnected body portions to receive respective parts of a body to be washed, the body portions each including:

i. an exterior surface and an interior surface to be adjacent to a part of a body;

ii. a water conduit for passage of water through the body membrane to the interior surface thereof to deliver liquid for washing a body part;

iii. an air conduit separate from the water conduit for passage of air through the body membrane to the interior surface thereof to deliver air for drying a body part; and b. a controller to control the passage of water and air independently through the water and air conduits respectively.

2. Apparatus in accordance with claim 1, wherein the air conduit of each body portion has a larger cross-sectional area than the water conduit of the respective body portion.

3. Apparatus in accordance with claim 1, wherein the body membrane comprises a water-resistant material.

4. Apparatus in accordance with claim 1, wherein the body membrane is adapted to receive the whole of a body therein.

5. Apparatus in accordance with claim 1, wherein the controller is provided adjacent the body membrane.

6. Apparatus in accordance with claim 1, wherein the controller is operable to supply air only to a body portion and water only to another body portion.

7. Apparatus in accordance with claim 1, further comprising support pads located on the interior surface of the body membrane on which a body may be supported when received within the body membrane.

8. Apparatus in accordance with claim 1, comprising a single pressing plastics-based material.

9. The apparatus for washing a body of claim 1 further comprising a reservoir in fluid connection with the body membrane so as to collect waste water exiting the membrane.

* * * * *